United States Patent [19]

Mayer

[11] Patent Number: 4,854,148

[45] Date of Patent: Aug. 8, 1989

[54] COLD DRAWING TECHNIQUE AND APPARATUS FOR FORMING INTERNALLY GROOVED TUBES

[75] Inventor: Dean L. Mayer, Fremont, Ind.

[73] Assignee: The Babcock & Wilcox Company, New Orleans, La.

[21] Appl. No.: 64,048

[22] Filed: Jun. 19, 1987

[51] Int. Cl.[4] ..... B21C 1/24

[52] U.S. Cl. ..... 72/68; 72/283

[58] Field of Search ..... 72/68, 77, 283

[56] References Cited

U.S. PATENT DOCUMENTS 4,313,328 2/1982 Janssen et al. ..... 72/283
4,646,548 3/1987 Zimmerli et al. ..... 72/68

FOREIGN PATENT DOCUMENTS 1064010 8/1959 Fed. Rep. of Germany ..... 72/283
3016135 10/1981 Fed. Rep. of Germany ..... 72/283
45208 4/1981 Japan ..... 72/283

*Primary Examiner*—Lowell A. Larson
*Attorney, Agent, or Firm*—Vytas R. Matas; Robert J. Edwards; Eric Marich

[57] ABSTRACT

Formation of continuous grooves on the internal surface of a tube shell, in a single continuous cold drawing step, in which the tube shell is first sunk in a die over a reduced diameter cylindrical mandrel portion so that the diameter of the inner surface of the tube shell is reduced to a dimension below the base of the grooves of a grooved plug portion of the mandrel thereby retarding longitudinal movement of a portion of the reduced internal surface of the sunk tube shell at a plurality of circumferentially spaced intervals to effect formation of longitudinally continuous shallow grooves. The mandrel is allowed to rotate if it is desirable to facilitate the formation of spiral grooves on the tube inner surface.

7 Claims, 1 Drawing Sheet

COLD DRAWING TECHNIQUE AND APPARATUS FOR FORMING INTERNALLY GROOVED TUBES

BACKGROUND OF THE INVENTION

This invention relates to the manufacture of internally grooved tubes and, more particularly, to an improved method of cold drawing tubes for forming continuous shallow grooves, narrowly spaced apart in either an axial or spiral orientation, on the inside surface of the tubes, and an apparatus therefor.

Known methods have been utilized to place grooves on the internal surfaces of tubes for different purposes. Such methods include machining, broaching, informing, extruding and drawing techniques.

Various grooving techniques are described in patent disclosures.

Hackett (U.S. Pat. No. 2,392,797), for example, discloses a technique for imparting rifling, fluting, ridging or the like to an internal tubular surface, particularly for a gun barrel or liner, through the use of a die and a mandrel arrangement including a mandrel having a surface configuration which is converse to that to be imparted to the tube. The die compresses the tube onto the mandrel, by relative axial movement of the tube and the die, as the tube moves through the die.

In Harvey, et al (U.S. Pat. No. 2,852,835), an apparatus is disclosed wherein metallic tubing is drawn through an annular formed by a stationary die and a cooperating rotatable rifling mandrel for simultaneously sizing the tubing and forming spiral projections on the interior surface of the tubing. The die includes a tapered frusto-conical lead-in portion followed by a cylindrical portion which gradually reduces the outside diameter of the tube to the desired final outside diameter. The initial contact of the internal surface of the tube on a portion of the rifling mandrel and the contact of the outer surface of the tube with the tapered lead-in portion of die occur concurrently. Hence, the spaced portions of the inside surface of the tube are radially forced into the grooves of the rifling mandrel simultaneously with a portion of the outer surface diameter reduction. No specific type of groove geometry is disclosed although the patent indicates that the technique is useful for the production of rifled aluminum barrels and the like.

Drawing techniques similar to that of Harvey, et al (U.S. Pat. No. 2,852,835) are shown by Nakamura, et al (U.S. Pat. No. 3,830,087), Koch, et al (U.S. Pat. Nos. 3,289,451 and 3,088,494), Hill (U.S. Pat. No. 3,292,408), House (U.S. Pat. No. 3,487,673), Sirois (U.S. Pat. No. 3,744,290), Stump (U.S. Pat. No. 4,161,112), and Tatsumi (U.S. Pat. No. 4,373,366). Grover, (U.S. Pat. No. 3,865,184) and Runyan, et al (U.S. Pat. No. 3,753,364), for example, both teach a horizontally disposed heat pipe as well as a method and apparatus for fabricating the heat pipe. Grover (U.S. Pat. No. 3,865,184) is primarily directed towards the actual heat pipe apparatus itself, describing, in detail, the very particular structure desired. Runyan, et al (U.S. Pat. No. 3,753,364) is primarily directed to a method and apparatus for producing capillary grooves on the inside tube surface of the heat pipe. The disclosed method and apparatus provide a means for fabricating a spiraled capillary groove by cutting the metal from the wall of the tube and raising and folding the cut metal over to provide a groove having a narrow opening for maximum capillary action. The cutting tool has a curved planar edge formed by the intersection of a planar surface and a cylindrical surface. The grooves produced thereby may have dimensions of a peak to trough depth on the order to 0.014 inches (0.3556 mm) and a spacing on the order of 0.007 inches (0.1778 mm) with the opening of the grooves narrower than the width of the grooves to provide optimum capillary action. The use of separate annular grooves of the same geometry is also disclosed. The method of placing the grooves in this inner tube wall surface is one of cutting with a cutting tool, and not a cold-drawing process.

When the metal for the inner surface of a tube shell is forced radially into grooves of a mandrel, there is a tendency for the metal to elongate along the longitudinal direction of the groove rather than radially filling the groove. This problem is exasperated as groove depth increases, as spacing between the grooves decreases, as drawing speed increases and, as well, in the case of hard metal workpieces.

In practice, no cold drawing method is known to the inventor which has been succesfully demonstrated as capable of making continuous shallow grooves in a hard metal such as steel, for example, continuous grooves having a depth of 0.020 inches (0.508 mm) with 0.040 inches (1.016 mm) between the grooves. More particularly, no cold drawing method is known to the inventor which is capable of rapidly making, in hard material, shallow continuous grooves that exhibit a uniform spiral along the length of the tube. Such grooves have particular application to heat pipes which use capillary grooves to transfer condensate from a condenser to an evaporator as the tubes exhibit increased heat transfer due to the extended surface and, accordingly, would be optimum "wicks" when used in thermosyphon-type heat pipe applications.

SUMMARY OF THE INVENTION

An improved method of cold drawing a tube shell for forming internally grooved tubes, according to the invention, includes in a continuous draw, the step of first reducing the internal diameter of a tube within a die and about a cylindrical mandrel portion prior to contacting the lead end of a larger-diameter grooved-mandrel portion, so that the internal diameter of the tube is reduced to a dimension not greater than the diameter of the grooved mandrel portion at the bottom of the mandrel grooves and then contacting the lead end with the reduced diameter tube portion to form the grooves.

An apparatus is provided for cold drawing an elongated tube shell to form a cold finished tube having an internal surface with a plurality of longitudinally extending grooves. The apparatus includes a die with a die land circumscribing a cylindrical bore and a generally conical approach zone circumscribing a tapering lead-in portion that forms a continuation of the bore. A mandrel is coaxially disposed within the bore and spaced from the surfaces of the die to define an annular spacing through which the tube shell is to be drawn. In accordance with the invention, the mandrel includes a substantially cylindrical grooved plug concentrically disposed within the cylindrical bore, a cylindrical bearing section having a diameter of smaller dimension than the minor diameter of the grooved plug, and a generally conical bearing section interconnecting the cylindrical bearing section to the grooved plug, the cylindrical bearing section disposed between the tapering lead-in portion and the cylindrical bore.

DETAILED DESCRIPTION

Figure 1:
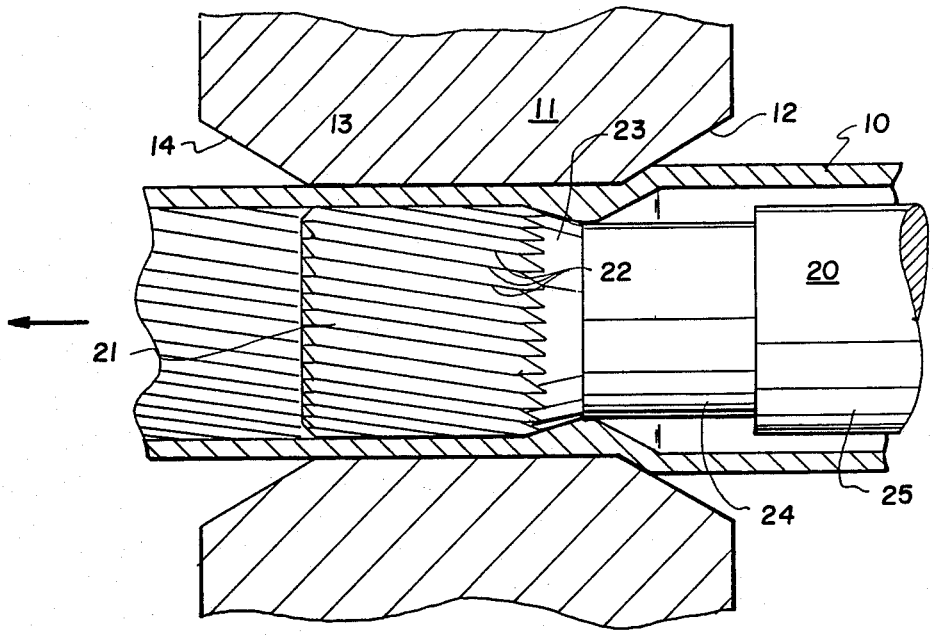
FIG. 1 is a side view, partly in section, showing a tube shell being drawn relative to a die and mandrel in accordance with the principles of the invention.

FIG. 1 illustrates a hollow tube shell 10 being drawn from right to left in the direction of the arrow through a conventional die 11 by pulling means (not shown) such as are well known in the art. The tube shell 10 has substantially cylindrical smooth internal and external surfaces prior to being drawn through the die 11.

The die 11 has a die opening including a tapering lead-in portion within a generally conical approach zone 12, a cylindrical bore within a cylindrical die land 13, and an expanding portion defined within a countersunk exit zone 14. The lead-in portion and expanding portion form a continuation of the bore at the fore and aft sides of the die 11.

An internal mandrel 20, preferably of hard or hard-surfaced material such as tungsten carbide, is co-axially inserted within the bore and spaced from the surfaces of the die to define an annular restraining spacing through which the tube shell 10 is to be drawn, as shown, to effectuate reduction and grooving of the internal surface of the tube shell 10. The mandrel 20 is composed of three working segments—a grooving plug 21 that has a working surface comprising a plurality of spiraled or axial grooves 22, a generally conical bearing section 23, and a cylindrical bearing section 24. The generally conical bearing section 23 is connected at its larger end to the grooving plug 21 and at its smaller end to the cylindrical bearing section 24. The cylindrical bearing section 24, at its end opposite the generally conical bearing section 23, is connected to a larger diameter cylindrical rod 25.

The mandrel 20 is oriented within the die 11 such that the cylindrical bearing section 24 extends coaxially of the die opening from within the generally conical approach zone 12 to within the cylindrical die land 13, and both the surface of the zone 12 and the die land 13 are concentrically disposed thereabout.

As the tube shell 10 is drawn through the die, the outer surface of the shell 10 first contacts the generally conical approach zone 12. The surface of the generally conical approach zone 12 thereby sinks the tube shell 10 about mandrel 20 at the smaller diameter mandrel section, i.e. cylindrical bearing section 24.

As shown in FIG. 1, reduction of the diameter of the outer surface of tube shell 10 commences in the generally conical approach zone 12 on a portion of the tube shell 10 which encircles the cylindrical bearing section 24, "before" the grooving occurs.

As shown in FIG. 1, the diameter of the inner tube wall surface of the tube shell 10 is sunk or reduced to a diameter that is equal to or smaller than the mandrel diameter at the bottom of the grooves 22 of the grooving plug 21. This placement overcomes the problem of the inner tube wall surface metal taking the easier path of elongating longitudinally rather than filling the grooves 22. In effect, this forms grooves in the inner tube wall surface with the projections or lands of the grooving plug 21 rather than attempting to force the inner tube all surface into the grooves 22 of the grooving plug 21.

The sunk or reduced inner surface of the tube shell 10 is then drawn into contact with and expanded over the generally conical bearing section 23 of the mandrel 20 and lead into the grooves 22 of the grooving plug 21. The projections or lands of the grooved surface of the grooving plug 21 retard the longitudinal movement of the reduced internal surface of the sunk tube shell at a plurality of circumferentially spaced intervals, thereby causing axial flow of the inner tube wall surface material into the grooves 22 of the surface of the grooving plug 21 to effect formation of a tube having a plurality of longitudinally extending grooves on the internal surface thereof.

The mandrel 20 is allowed to rotate, if it is desirable to facilitate the formation of grooves having a spiral orientation on the inside surface of the tube shell 10.

Sinking of the internal diameter of the tube shell 10 prior to contacting the groove lead-in portion (generally conical bearing section 23) to a dimension in which the internal diameter is no larger than the diameter at the bottom of the mandrel grooves 22 has been found to be critical. If this is not done, the tube material elongates longitudinally rather than entirely filling the grooves 22 radially.

The generally conical lead-in or bearing section 23 to the flat grooving surface of the grooving plug 21 is required to assure that sufficient tube material is longitudinally fed to the grooves 22. The groove finish of the mandrel grooving plug 21 must be relatively smooth to allow proper material flow. Excessive roughness causes misshape and cratered tops on the lands placed in the tube shell 10; a surface finish of approximately 3 microinches has been shown to be effective, and it is estimated that a 30 microinch or better finish is required.

During the grooving operation, it is preferable to further sink the outside diameter by at least 9% and to achieve a reduction of the tube wall thickness of at least 20%. These minimum reductions are requied to yield sufficient axial force to cause the tube material to flow into the grooves 22 rather than over the lands. The tube shell 10 should be annealed prior to cold drawing, to allow sufficient tube material ductility to cause proper flow.

Figure 2:
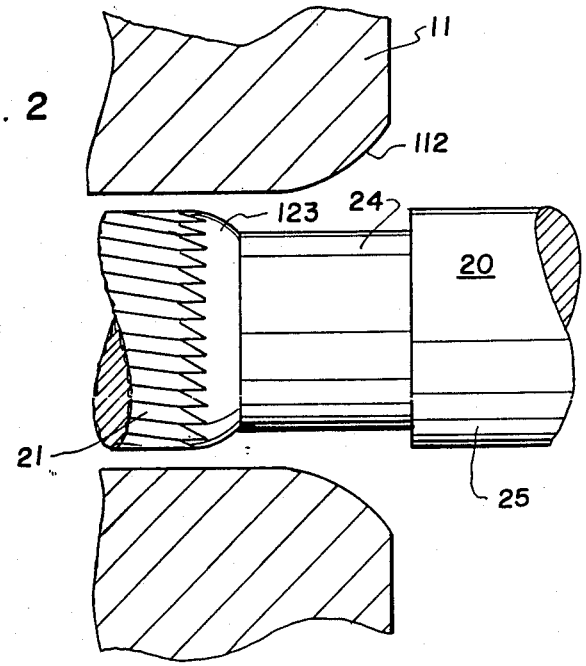
FIG. 2 is a partial view, similar to FIG. 1, showing the die and mandrel of another embodiment of the invention.

In FIG. 2, the reference numerals (one hundred numbers displaced from the embodiment of FIG. 1) are used to designate parts which are similar to those on the embodiment of FIG. 1. The embodiment of FIG. 2 differs from that of FIG. 1 in that the approach zone 112 and bearing section 123, while still conical, are curved convexly (as shown) or concavely (not shown).

The present invention has been shown to be capable of providing grooved tubes at rates of draw in excess of 34 feet per minute, using the special grooving mandrel, a standard tube drawbench and normal equipment to prepare tubes for drawing. Variable groove spiral geometries can be made; 9" to 20" lead spirals have been successfully made with groove fineness from 24 per inch to above 35 per inch.

The invention claimed is:

1. A method of cold drawing an elongated tube shell in a single continuous draw pass to form a cold finished tube having an internal surface with a plurality of longitudinally extending grooves. which comprises: longitudinally drawing the tube shell along a mandrel, sinking the tube shell to reduce the diameter of the interanl surface of the tube shell to a dimension below the minor diameter of the grooves to be formed, then progressively enlarging the reduced internal surface of the tube shell, and next longitudinally retarding the longitudinal movement of a portion of the reduced internal surface of the tube shell at a plurality of circumferentially spaced intervals to effect formation of the grooves while concurrently, with the formation of the grooves, reducing the outer diameter of the tube shell by at least 9% and reducing the wall thickness of the tube shell by at least 20% along the same portion of the reduced internal surface of the tube shell.

2. A method of cold drawing, as set forth in claim 1, further comprising the step of providing a freely rotating mandrel and spirally grooved plug to uniformly spiral the grooves along the length of tube.

3. A method of cold drawing, as set forth in claim 2, further comprising the step of annealing the tube shell prior to cold drawing.

4. A method of cold drawing, as set forth in claim 2, wherein the spirally grooved plug has a groove surface finish of approximately 3 microinches.

5. A method of cold drawing an elongated tube shell in a single continuous draw pass to form a cold finished tube having an internal surface with a plurality of longitudinally extending grooves, which comprises:

longitudinally drawing the tube shell concentrically over a mandrel to and through a die bore of the type having a cylindrical bore and a tapering lead-in portion forming a continuation of the bore, the mandrel including a substantially cylindrical grooved plug concentrically within the cylindrical bore, a cylindrical bearing section having a diameter of smaller dimension than the minor diameter of the grooved plug, and a generally conical bearing section interconnecting the cylindrical bearing section to the grooved plug, the cylindrical bearing section being disposed partly within the tapering lead-in portion and the cylindrical bore, and where the grooved plug includes a surface with a plurality of longitudinally extending grooves having a groove surface finish of approximately 3 microinches and which are circumferentially spaced about the surface; and sinking the tube shell about the cylindrical bearing section to an internal diamter of a dimension less than the diameter of the grooved plug at the base of the grooves.

6. A method of cold drawing, as set forth in claim 5, wherein the outer diameter of the tube shell is reduced by at least 9% and the wall thickness of the tube shell is reduced by at least 20% during the drawing process to facilitate formation of the grooves in the tube shell.

7. In an apparatus for cold drawing an elongated tube shell to form a cold finished tube having an internal surface with a plurality of longitudinally extending grooves, the apparatus being of the type with a die having a die land circumscribing a cylindrical bore anc a generally conical approach zone circumscribing a tapering lead-in portion forming a continuation of the bore, and a mandrel coaxially disposed within the bore and spaced from the surfaces of the die to define a spacing through which the tube shell is to be drawn, the improvement wherein the mandrel includes a substantially cylindrical grooved plug having a groove surface finish of approximately 3 microinches concentrically disposed with the cylindrical bore, a cylindrical bearing section having a diameter of smaller dimension than the minor diameter of the grooved plug, and a generally conical bearing section interconnecting the cylindrical bearing section to the grooved plug, the cylindrical bearing section being disposed partly within the tapering lead-in portion and the cylindrical bore.

* * * * *